United States Patent [19]

Saiia

[11] 3,990,125

[45] Nov. 9, 1976

[54] MOBILE SWEEPER

[75] Inventor: Anthony Joseph Saiia, Milwaukee, Wis.

[73] Assignee: Jacobsen Manufacturing Company, Racine, Wis.

[22] Filed: Dec. 29, 1975

[21] Appl. No.: 644,644

[52] U.S. Cl. ..... 15/340; 15/83

[51] Int. Cl.[2] ..... E01H 1/04

[58] Field of Search ..... 15/49 C, 50 C, 79 R, 15/79 A, 83–87, 340

[56] References Cited

UNITED STATES PATENTS

| | | | |
|---|---|---|---|
| 1,142,415 | 6/1915 | Gardner | 15/84 |
| 2,268,059 | 12/1941 | Parker et al. | 15/83 |
| 2,784,440 | 3/1957 | Newport | 15/83 X |
| 2,833,116 | 5/1958 | Rush | 15/83 X |
| 3,461,474 | 8/1969 | McCandless | 15/83 |
| 3,670,359 | 6/1972 | Gutbrod | 15/83 |
| 3,761,988 | 10/1973 | Overton | 15/83 |

*Primary Examiner*—Edward L. Roberts
*Attorney, Agent, or Firm*—Arthur J. Hansmann

[57] ABSTRACT

A mobile sweeper having a body and ground-engaging wheels. The body defines a trash compartment which has a bin having a top plate such that trash can be swept into the bin and also thereabove onto the top plate. Sweeping reels are disposed in front of and rearwardly of the body compartment for sweeping the trash into and onto the bin. A closure or door is included in the body and can be opened for dumping the trash from the compartment, and a hydraulic system is employed for opening the door and for effecting the dumping of the trash.

17 Claims, 6 Drawing Figures

FIG. 1
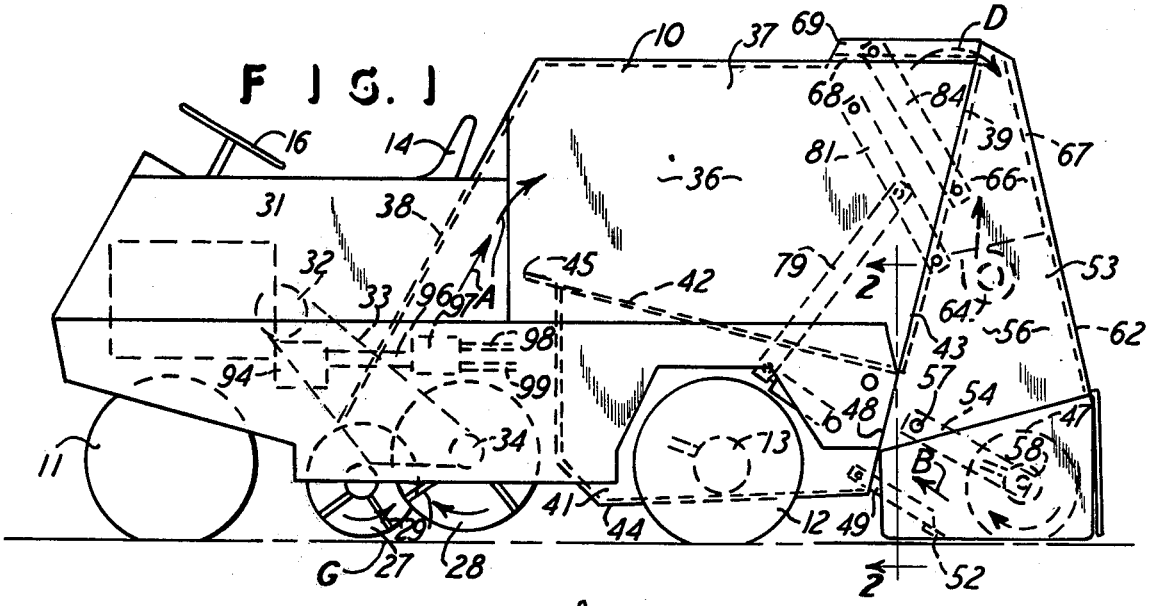
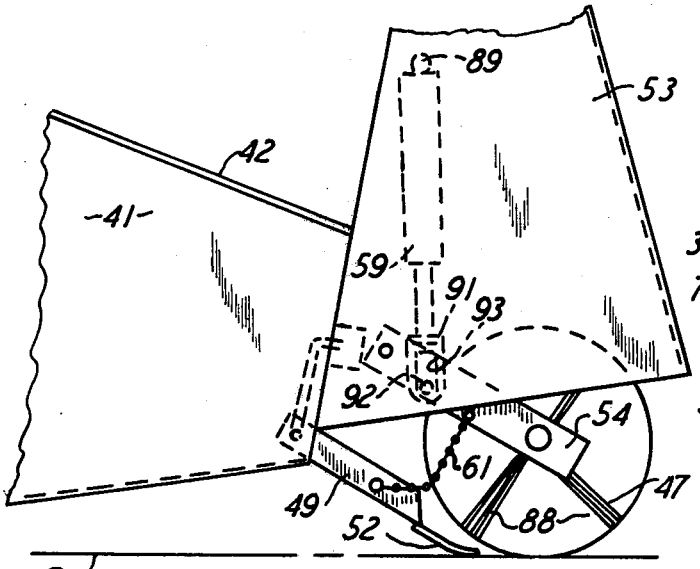
FIG. 3
FIG. 2
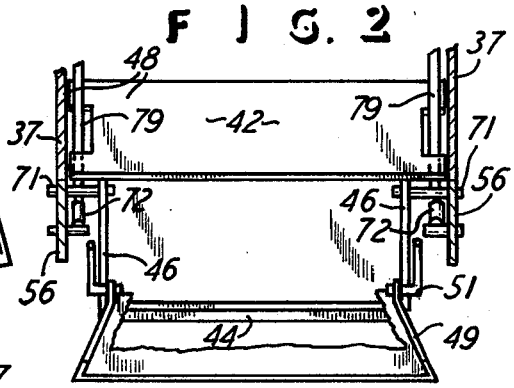
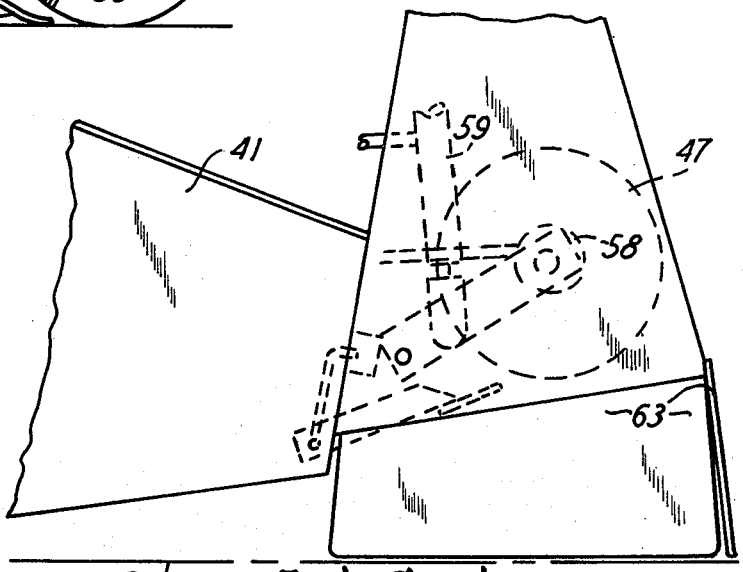
FIG. 4

MOBILE SWEEPER

This invention relates to a mobile sweeper for sweeping trash from paved surfaces and from turf and ground and the like, and it is self-propelled and has powered sweeping reels.

BACKGROUND OF THE INVENTION

Trash sweepers for use on paved surfaces and for use on grass or turf are already well known in the prior art. These prior sweepers employ sweeping brooms and reels and the like for sweeping the trash up from the ground and into a compartment in the sweeper. U.S. Pat. Nos. 2,661,584 and 3,112,593 and 3,221,483 and 3,331,195 all show examples of mobile sweepers which have rotating brooms or reels which sweep the trash from the pavement or ground or the like. Also, U.S. Pat. No. 2,916,753 shows a sweeper having a plurality of reels which sweep trash up into a container.

The present invention is an improvement upon the prior art sweepers in that the present invention provides a sweeper which is very compact and which is versatile in that the sweeper can be used on paved surfaces and it can also be used on turf or grass without damaging the grass. Accordingly, in accomplishing this objective, the sweeper of this invention has sweeping reels which are particularly useful in sweeping paved surfaces and it also has a sweeping reel which is particularly useful in sweeping turf or grass, and the reels can be used either simultaneously or singly such that a surface can be swept with both types of reels or it can be swept with either type of reel while the other reel remains inactive. That is, a sweeping reel which is most efficient on paved surfaces is not at all appropriate for sweeping turf or grass since it would damage the grass, and the present invention provides a sweeper which has an arrangement wherein the reels can be used separately and without using the other reel, if and when desired.

Another object of this invention is to provide a mobile sweeper wherein the trash can be swept into one general compartment in the sweeper itself, and that one compartment can be supplied with trash by the two broom systems mentioned, but yet the trash can be emptied from the sweeper in one maneuver and into one pile of trash. In accomplishing this objective, certain of the sweeping reels can direct the trash to one portion of the trash compartment and others of the sweeping reels can direct the trash to another portion of the trash compartment, but both portions or compartment segments can be emptied at the same time and into one trash pile.

Another object of this invention is to provide a mobile and powered sweeper which has provision for controlling the dust commonly created in the sweeping action, and the dust and light dirt or debris is directed into a secondary trash compartment which is emptied along with the emptying of the main trash compartment, all in one maneuver of emptying, as mentioned above.

Still further, the present invention provides a mobile sweeper which has a trash compartment enclosing a bin which receives trash from one of the sweeping reels, and the bin also presents a top which receives trash from another of the sweeping reels, and one motion of opening the trash compartment and emptying the bin, both from its interior and on its top, can be achieved in one motion and with one powered mechanism in the nature of hydraulic equipment which is employed herein.

Still further, the present invention provides a mobile sweeper which has a trash compartment having an emptying opening which is covered by a closure which is under the control of powered mechanism and is moved to a position for opening the trash compartment and emptying the contents thereof. Further, the sweeper has powered mechanisms which control the rotation of the sweeper reels and which raise and lower them and which also control the opening and closing of the closure on the trash compartment. The powered mechanism includes sequentially operated controls which will place the sweeper reel into an inoperative position prior to opening the closure, and the sequential operation also finally performs the function of maneuvering the trash supporting members to empty them after the closure has been moved to an open position.

Other objects and advantages will become apparent upon reading the following description in light of the accompanying drawings.

BRIEF DESCRIPTION OF THE DRAWINGS

FIG. 1 is a side elevational view of a mobile sweeper of this invention.

FIG. 2 is a sectional view taken along the line of 2—2 of FIG. 1.

FIGS. 3 and 4 are side elevational views of a rear fragment of the sweeper shown in FIG. 1, and with the showing being enlarged and with parts thereof in two different positions between the two views.

DETAILED DESCRIPTION OF THE PREFERRED EMBODIMENT

Figure 5:
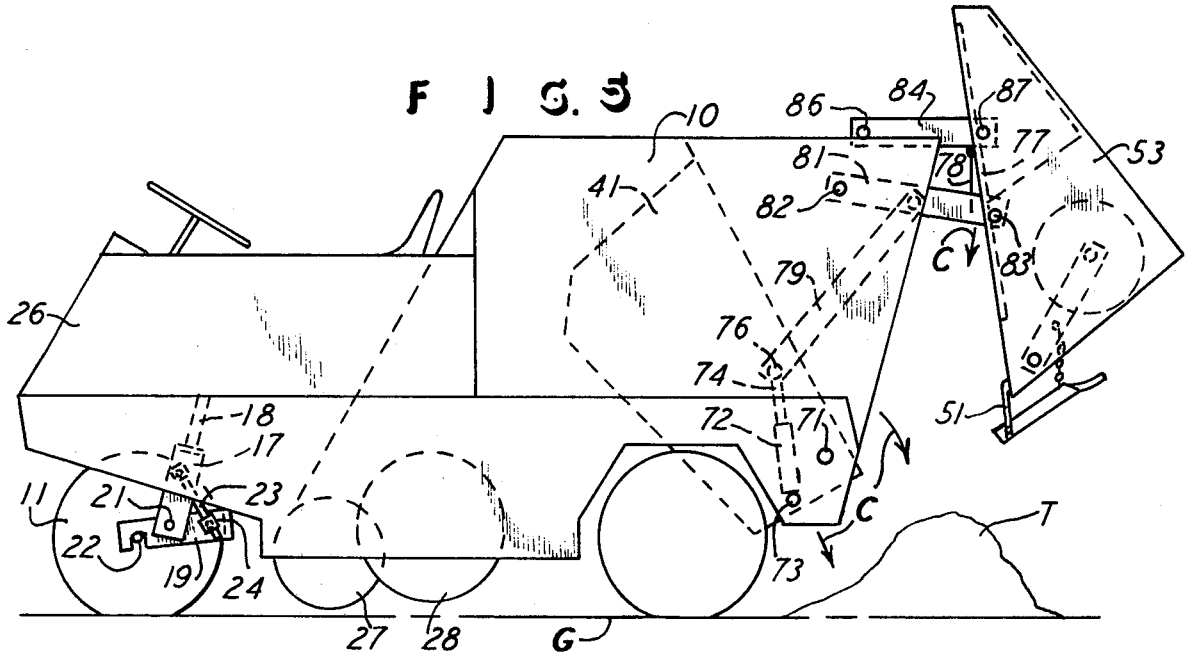
FIG. 5 is a side elevational view of the sweeper of FIG. 1 and showing parts thereof in positions different from that shown in FIG. 1.

The drawings show the mobile sweeper to include a body 10 ground supported on ground-engaging wheels 11 and 12. The wheel 11 is a single front wheel, and the wheels 12 are two rear wheels which are powered by a hydraulic motor 13 suitably connected with the two rear wheels 12 for driving them. The sweeper includes an operator's seat 14 and a steering wheel 16 which steerably controls the single front wheel 11, and the control may be through any conventional steering connection with the wheel 11, and FIG. 5 shows a yoke 17 extending from a steering column 18, and the yoke 17 extends to opposite sides of the wheel 11. Another yoke 19 is pivoted to the yoke 17 through a pin 21, and the yoke 19 also engages the wheel axle 22, and thus the front end of the sweeper is supported on the front wheel 11. FIG. 5 further shows that the yokes 17 and 19 are adjustably secured together by means of a threaded strut 23 which has its opposite ends pivotally connected to the respective yokes 17 and 19 such that the strut 23 can be rotated in a threaded support block 24 swively connected with the lower yoke 19, and thus the two yokes 17 and 19 can be moved relative to each other about the common attachment pin 21. With that adjusting arrangement, the front wheel 11 can be adjustably positioned relative to the remainder of the sweeper, and thus the front end 26 of the sweeper can be raised and lowered. Sweeping reels 27 and 28 are rotatably mounted on the sweeper body 10 and they extend with their axes transverse to the fore-and-aft direction of movement of the sweeper, and they extend across the width of the sweeper. The sweeping reels or members 27 and 28 include sweeping fingers 29 which are preferably of a rubber or flexible material, and the sweepers rotate in the direction of the arrow shown thereon in FIG. 1, and they thus counterrotate relative to each other, and the sweeper fingers 29 intermesh between the two reels 27 and 28 and they operate on the ground line G to pick up the trash therefrom and move the trash to a position between the reels 27 and 28 and impel it upwardly into the body 10 in the direction of the arrows A. With this arrangement, the sweeper reels 27 and 28, by virtue of their rubber fingers 29 or the like are suitable for sweeping on grass or turf without damaging the turf, and they are also suitable for sweeping on paved surfaces.

The sweeper is also shown to include an engine 31 which renders the sweeper self-powered and self-propelled, and the reels 27 and 28 are powered from the engine 31 by means of a pulley 32 driven off the engine 31 and a belt 33 which extends to the pulleys 34 on the sweeper reels 27 and 28.

With the reels 27 and 28 rotatably mounted on a fixed axis relative to the sweeper body 10, adjustment of the front wheel 11 by means of the heretofore described adjustment strut 23 will permit elevation adjustment of the reels 27 and 28 relative to the ground line G.

The body 10 encloses and defines a trash collecting compartment designated 36, and that compartment is defined by the two laterally spaced-apart side walls 37 of the body 10 and by a front partition 38 along which the trash is impelled, as shown by the arrows A, and the rear of the compartment is defined by a wall 39 extending across the width of the body 10 as does the wall 38. Also, the trash compartment 36 is described to include a trash collecting bin 41 which is disposed between the body side walls 37 and extends through the lower portion of the compartment 36, as shown. Of course the body 10 is suitably supported on the two spaced-apart rear wheels 12, in any conventional manner and as will be readily understood or known by one skilled in the art.

The bin 41 has a top plate 42 which extends from the plane of the rear wall 39, which is along the solid line designated 43 and which shows the rear edge of the trash compartment 36, and the bin plate 42 extends at the angle shown and toward the front partition 38 but is spaced therefrom to permit the trash to move between the plate front edge 45 and the partition 38, as indicated in FIG. 1. The plate 42 forms a trash supporting member or floor for trash picked up and impelled by the reels 27 and 28, as indicated, and the plate 42 angles downwardly to the rear of the sweeper, and thus the trash moved in the direction of the arrows A will be securely retained in the compartment 36 and on the plate 42 at a location adjacent the rear of the compartment, such as defined by that line 43, as mentioned.

Also, the bin 41 receives trash from the ground, and it will be seen and understood that the bin 41 includes a bottom designated 44 and side walls 46, in addition to the top plate 42, all as seen in FIGS. 1 and 2. To impel trash into the bin 41, the sweeper has a rotatably-mounted reel or sweeping brush 47 disposed rearwardly of the bin 41 and driven to rotate in the direction of the arrow shown thereon, and thus trash is picked up by the reel 47 and is moved in the direction of the arrow designated B and the trash is therefore moved into the bin 41 which has a rear opening designated 48. Also, a trash pan 49 is pivoted relative to the bin 41 and extends rearwardly and downwardly therefrom to ride on the ground line G and thus direct and guide the trash up the pan 49 and into the bin 41. It will be further noticed that the bin bottom 44 is slanted downwardly toward the front of the sweeper, and thus the trash in the bin 41 will remain therein until it is intentionally emptied from the bin 41, as hereinafter described and shown in connection with FIG. 5. Thus, the trash pan 49 is adjacent the bin 41 by means of the arms 51 in the bin sides 46, and the pan 49 is shown to have a rubber flap 52 which will actually ride along the ground G, as best seen in FIG. 3.

The reel 47 is rotatably mounted on the sweeper by positioning it on a closure member 53 which is movably attached to the unit and is a part of the unit's body 10 and is therefore a segment of the body. The closure 53 presents its forwardly located wall 39 across what is the rear opening of the compartment 36 as defined by the body sides 37 and as the trash compartment opening extends in the plane of the body line 43, as described. Thus, in the operating and closed position of FIG. 1 of the body 10, that is with the closure 53 having its partition or wall 39 against the opening of the trash compartment 36, trash is accumulated in the compartment 36 as it is impelled by the front reels 27 and 28 and onto the support member or plate 42. Further, the rear reel 47 is rotatably mounted on the rear closure 53 by means of two arms 54 which extend along the spaced apart side walls 56 of the closure 53, and the two arms 54 are pivoted to the closure by means of the pivot pins 57 on the closure 53. Thus, the rear reel 47 is rotatably mounted on the extending ends of the two arms 54, and it will be seen and understood that the rear reel 47 can be disposed between its lowered operating position of FIG. 3 and its raised inoperative or the transport position of FIG. 4. Rotation of the rear brush or reel 47 is by means of a hydraulic motor 58, and raising and lowering of the rear reel 47 is by means of the hydrualic cylinder assembly 59. Also, FIG. 3 shows that the trash pan 49 is connected to the arms 54 by means of a chain 61, and thus raising the reel 47 will raise the pan 49, such as to the positions shown in FIGS. 4 and 5, and the pan 49 is then in the transport position and it is also then presenting a closure for the otherwise open rear end of the bin 41, as described as the opening 48. The closure 53 therefore has a rear wall 62 which extends between the side walls 56 and which therefore closes off the rear end of the sweeper and provides a compartment for receiving the reel 47 and the arms 54 and the pan 49, as shown and described. Also, rubber flaps or skirts 63 are attached to the closure sides 56 and rear wall 62 and depend therefrom to extend down toward the ground G, and thus a dirt and dust secure arrangement is provided so that the reel 47 can direct the trash along the path indicated by the arrow B, and the dust can be reasonably collected and directed upwardly in the closure 53, and it can be moved by a blower 64 which is suitably mounted on the closure 63 which directs the dust in the direction of the arrow shown thereabove and into a dust collecting compartment 66 in the upper end of the closure 53. Further, a filter member or screen 67 extends across the rear of the closure 53 and is in air-flow communication with the compartment 66 to permit the air to escape from the compartment 66 while filtering the dust therefrom. In a similar arrangement, an air filter or screen 68 extends along the top of the body 10 and an air duct 69 encloses the screen 68 and permits air to flow from the compartment 36 and into the compartment 66, under the force of the air moved by means of the front reels 27 and 28 as they operate relative to the main trash compartment 36. In this arrangement, dust and any light dirt particles are collected in the compartment 66, and thus the unit is relatively dustless in its operation, and the arrow designated D shows the flow of dust-laden air from the compartment 36 and into the compartment 66.

FIG. 5 shows the position of the various parts when the trash is being emptied from the sweeper, and here it will be seen and understood that the bin 41 is pivotally mounted relative to the remainder of the body 10 by means of pivot pins 71 which are mounted on the body opposite side walls 37. A hydraulic cylinder assembly 72 is also mounted on each of the side walls 37 by means of a pivot pin 73, and the assembly rod 74 is pivotally connected to the bin 41 by means of the pin 76 extending through the bin side wall 46, and that would be true on each side wall 46. Accordingly, extension and contraction of the cylinder assembly 72 will cause the bin to pivot between the FIG. 1 and the FIG. 5 positions. Of course such pivoting action will result in the emptying of the trash compartment 36, such as shown by the pile of trash designated T in FIG. 5, and the trash will fall from the compartment 36 in the direction designated by the arrows C. At this time it will also be seen and understood that the secondary trash compartment 66 will be emptied, and it has an opening designated 77 which is closed by a gravity-controlled flap 78 which moves to the open position shown in FIG. 5 when the unit is in the dumping mode, and thus again the arrow designated C indicates the movement of the trash and dust from the compartment 66.

To move the rear closure 53 to the dumping position shown in FIG. 5, a link 79 is pivotally connected between the pin 76 and an arm 81 which in turn is pivotally connected to a pin 82 on the body 10 and a pin 83 on the closure portion 53. Of course this arrangement would be on each side of the sweeper unit, as will be understood by one skilled in the art. Thus, extension of the cylinder assembly 72, as shown in FIG. 5, will cause the bin 41 to pivot upwardly and be emptied, and it will also cause the link 79 to move upwardly and thereby pivot the arm 81 in a counterclockwise direction about its mounting pivot pin 82, and, along with an arm 84 which is pivoted between the body side wall 37 and the closure 53, by means of pivot pins 86 and 87, the closure 53 will move to the position of FIG. 5. FIG. 2 shows the dual arrangement of the cylinder assembly 72 and the links 79 and the mounting and pivot pins mentioned. It also shows that the body walls 36 and 56 are related to each other for the purpose of providing the trash compartment 36 and enclosing the same and for providing the arrangements for the purpose mentioned above. FIG. 2 also shows the pan 49 with a portion thereof broken away, for purposes of showing the bin bottom 44, and it shows the pan sides angled inwardly to align with the bin 41 and direct the material into the bin through its opening 48. As mentioned, the pan 49 is actually suspended from the closure member 53 so that it moves with the closure member 53 in the FIG. 5 mode, and thus the pan 49 also responds to the transport mode for the rear brush 47, for the purpose apparent and indicated. It will also be seen and understood that the brush 47 is arranged with fibers 88 which are most suitable for brushing paved surfaces and hard ground or the like, but the fibers 88 are not acceptable on turf or grass, and it is then important that the rear reel 47 be raised to the inoperative position of FIG. 4 when the sweeper is being used on turf or grass. With this arrangement, the sweeper is versatile in that it can be used both on paved surfaces and on turf, and, under some conditions, all reels can be used simultaneously.

FIG. 3 shows the rear cylindrical brush or reel 47 operative on the ground G, and the arms 54 are under the control of the cylinder assembly 59 which is suitably pivotally mounted by means of the pin 89 to the closure wall 56. The lower end of the assembly 59 has a clevis 91 which engages a pin 92 on the arm 54. Of course contracting the assembly 59 from the FIG. 3 position and to the FIG. 4 position will cause the upward pivot of the arms 54 and thus the raising of the reel 47 and the pan 49, as mentioned heretofore. Also, the clevis 91 has a slot 93 which provides loose engagement for the pin 92, and therefore the brush 47 can be self-adjusting relative to any irregularities in the ground G since the brush can move up and down within the limits of the slot 93. FIG. 1 further shows that there is a hydraulic pump 94 which is driven from the engine 31, by any suitable interconnection therebetween, and the pump 94 has a hydraulic line 96 extending to a hydraulic valve 97 which in turn has hydraulic lines 98 and 99 extending to the powered units described, that is the wheel motors 13 and the reel motor 58 and the cylinder assemblies 59 and 72.

Figure 6:
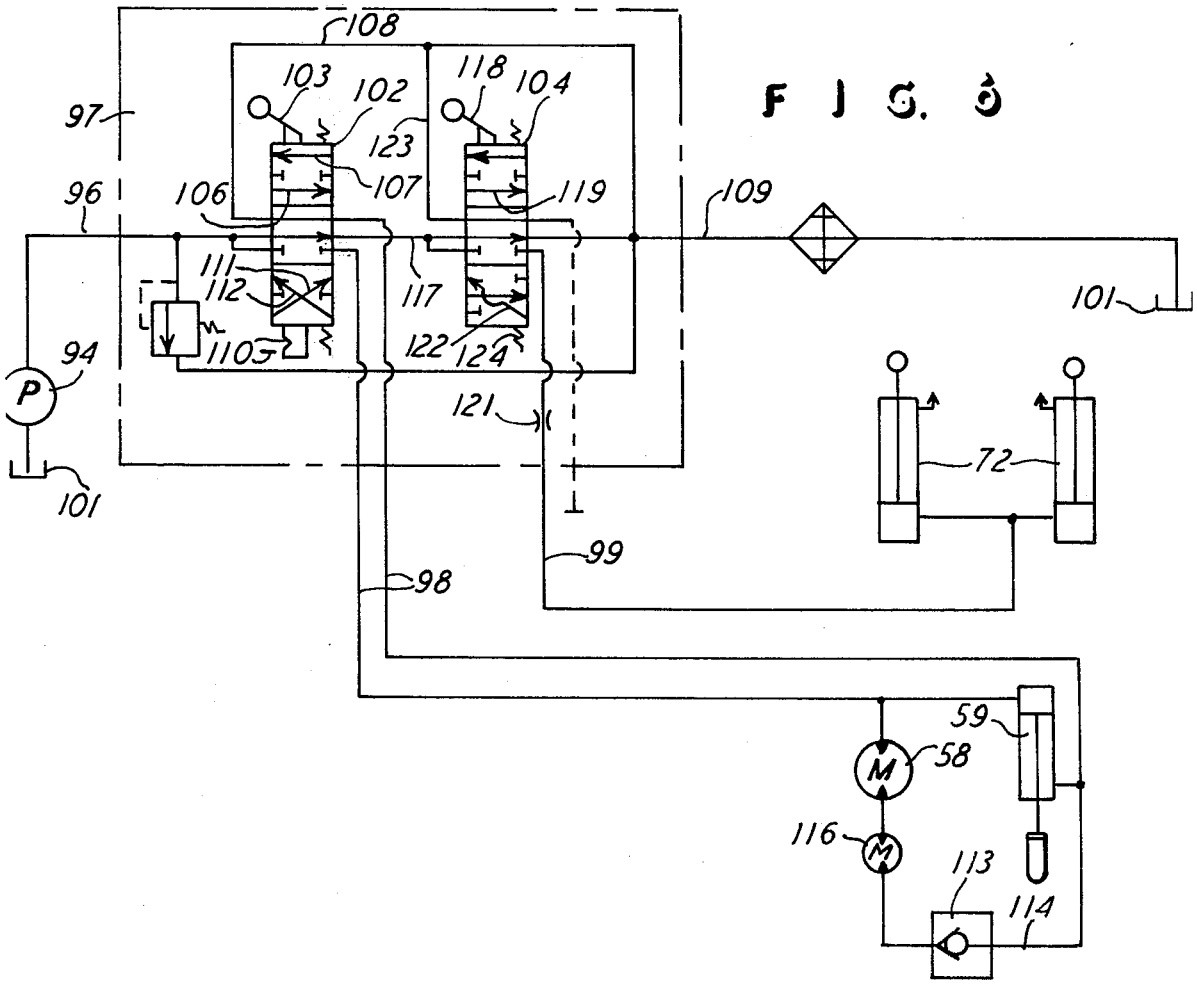
FIG. 6 is a hydraulic schematic of the hydraulic equipment employed in the sweeper shown in FIG. 1.

FIG. 6 shows the arrangement of the powered mechanism which is shown to be the hydraulic system, some of which has been heretofore described, and the pump 94 and the hydraulic line 96 and the valve unit 97 and the hydraulic lines 98 and 99 and the reel motor 58 and the reel lift cylinder assembly 59 and the dumping actuating cylinder assembly 72 are all shown. With this arrangement, the pump 94 will receive hydraulic fluid from the reservoir 101 and will direct it into the valve 97 and to a first valve section or spool 102 which is controlled by a handle 103. The valve 97 also has another spool 104, and FIG. 6 shows the spools 102 and 104 in the inoperative position and any fluid moved from the pump 94 and through the valve 97 is simply returned to the reservoir. However, when the spool 102 is shifted downwardly, as seen in FIG. 6, then the spool passageway 106 is in flow communication with the line 96 and directs fluid through the left one of the lines 98 and to the brush drive motor 58 and also to the end of the assembly 59. The assembly 59 is thus caused to extend and thereby lower the reel 47, and, because of the motor 58 and assembly 59 are in a parallel hydraulic connection arrangement, the motor 58 will not be receiving full hydraulic power and it will therefore operate slowly while the reel 47 is being lowered, and this is desirable so that the reel is not operating at a high speed when it engages the ground G. However, when the assembly 59 is fully extended, then the complete power if directed to the motor 58 for the full rotational power desired for the reel 47 in its operating position. During this arrangement, the fluid will of course pass through the motor 58 and it will also pass from the other end of the double acting assembly 59 and will go through the right-hand one of the two lines 98 and back through the spool 102, via the spool passageway 107, and that will of course connect with the line 108 and permit the fluid to return to the reservoir through the connecting line 109, as shown. Also, the spool 102 is under the influence of a usual type of detent and latch 110 which holds the spool 102 downwardly in the running mode just described, and thus the operator need not hold the spool all the time that the rear reel 47 is operating.

FIG. 6 also shows that if the spool 102 were shifted upwardly, then the spool passageways 111 and 112 would reverse the flow in the two lines 98 and cause the cylinder 59 to contract and thereby raise the rear reel 47. However, a check valve 113 in the line 114 extending between the ends of the lines 98 and with the powered elements 58 and 59, as shown, would prevent reverse rotation of the motor 58 in the transport or raised or inoperative position, all as desired. At this time it will also be noticed that another motor 116 is shown in the hydraulic system and connected with the line 114, and this motor 116 is the hydraulic motor which is incorporated in the blower 64 so that the blower 64 is always operating when the motor 58 is operating, as desired.

With what has been heretofore described, it will be seen and understood that there is no hydraulic pressure in the valve section having the spool 104 when there is pressure at the spool 102 as just described. Therefore, the unit cannot be activated to be dumping when the reel 47 is being raised or lowered or when it is in its rotation and operating position by being powered from the motor 58. However, in order to actuate the dumping cylinder 72, the spool 102 is placed in its inoperative position shown in FIG. 6, and the fluid pressure is then passed through a passageway 117 and to the spool 104. Accordingly, control of the spool 104 by a handle 118 will permit shifting the spool 104 downwardly to where its line 119 will align with the line 99 and thus direct the hydraulic pressure to the end of the cylinder assemblies 72 which need only be single-acting cylinders, as shown, and that will create the dumping action and position the assemblies 72 in the mode shown in FIG. 5. A flow restrictor 121 is in the line 99 to slow and cushion the dumping and lowering of the bin 41 through the action of the cylinders 72. It will also be seen and understood that when the spool 104 is shifted upwardly, as seen in FIG. 6, then flow can go out of the line 99 and through the spool passageway 122 and into the line 123 which causes the fluid to return to the reservoir 101, and that permits the bin 41 and its attached parts, including the closure 53, to return to the operating position of FIG. 1 as the single-acting assemblies 72 return to the contracted position shown in FIGS. 1 and 6. Further, the spool 102 is a so-called detented type which can be self-sustaining in the operating position, but the spool 104 is arranged with a return spring on each end thereof, such as the spring 124, and thus, when the operator releases the handle 118, the spool 104 returns to its neutral position shown in FIG. 6, so the spool 104 cannot be inadvertently left in an operative position and pass working fluid therethrough only in response to positioning of the spool 102.

The above therefore discloses the arrangement of the sweeper having the body with the enclosed trash compartment with the trash support tiltably disposed therein and with the powered sweeping reels and with the closure means of the assembly 53 and with the emptying means of the cylinder assembly 72 and the attached pins and arms 79 and 81 and 84. The trash support and the closure means 53 are interconnected in part by the arms 81 and 84 for simultaneous action of opening the closure means and moving the trash support for emptying the bin 41 and moving the trash off the bin top plate 42. In this arrangement, the body 10 includes the two segments generally defined by the side walls 37 and by the closure means 53. The unit is therefore arranged to have the combination of turf and pavement brooms, and the attending variety of sweeping actions as described. It is also arranged so that the trash for the several locations desccribed can be emptied into one pile T, as shown in FIG. 5, and this is accomplished even though the trash is collected from the two longitudinally spaced-apart brush systems of the various forwardly disposed reels 27 and 28 and rearwardly disposed reel 47. Further, the rear reel 47 can be placed in the inoperative position as shown in FIG. 4, and the plan 49 is automatically moved to the trash-retaining position of FIG. 4. Also, the adjustment at the front wheel 11 will permit positioning the front reels 27 and 28 from the operative to the inoperative position, irrespective of an inoperative position of the rear reel 47.

What is claimed is:

1. A mobile sweeper comprising a body having an enclosed portion defining a trash compartment, a trash support tiltably disposed in said enclosed portion, wheels on said body for mobilely supporting the sweeper on the ground in the fore-and-aft direction of movement of the sweeper, powered sweeping reels rotatably mounted on said body and having axes of rotation disposed transverse to the sweeper fore-and-aft direction of movement and extending to the ground for sweeping and throwing trash into said compartment, some of said sweeping reels being in front of said compartment and the remainder of said sweeping reels being behind said compartment, relative to the forward direction of movement of the sweeper, closure means on said body and operatively associated with said enclosed portion and extending adjacent thereto and being movable away from said enclosed portion for opening said compartment, and emptying means connected with said trash support for tilting said trash-support to empty said compartment through the opening left by said closure means.

2. The mobile sweeper as claimed in claim 1, including connection means operatively associated with said trash support and said closure means for simultaneous actuation of said support and said closure means in the emptying of said compartment.

3. The mobile sweeper as claimed in claim 1, wherein said some of said reels are of a sweeping material for sweeping turf, and said remainder of said reels are of a sweeping material different from the first-mentioned sweeping material for sweeping paved surfaces.

4. The mobile sweeper as claimed in claim 1, wherein said some of said reels consist of two reels disposed adjacent each other and in a radially overlapping rotational arrangement for cooperation therebetween and being rotatable in opposite directions for picking up trash therebetween and impelling it into said compartment.

5. The mobile sweeper claimed in claim 1, wherein said trash support includes two trash supporting members disposed one above the other, and with said body having a trash passageway respectively extending between said some of said reels and the upper one of said members and between said remainder of said reels and the lower one of said members.

6. The mobile sweeper as claimed in claim 5, wherein said trash supporting members are both tiltable toward the opening left by said closure means, for dumping the trash off both said members and into a single pile.

7. The mobile sweeper as claimed in claim 6, wherein said body enclosed portion and closure means consists of two segments hinged together and being separable for emptying the trash from said body and through the separation space between said segments.

8. The mobile sweeper as claimed in claim 5, wherein said trash supporting members are both tiltable toward the opening left by said closure means, for dumping the trash off both said members and into a single pile, and said some of said reels being mounted on said body and said remainder of said reels being movably mounted on and retractable upwardly into said closure means and off the ground to a non-sweeping position.

9. The mobile sweeper as claimed in claim 1, wherein said trash support includes a bin pivotally disposed adjacent said remainder of said reels for receiving trash swept up by said remainder of said reels, and said bin includes a top plate extending over said bin for receiving the trash swept up said some of said reels.

10. The mobile sweeper as claimed in claim 9, including a trash pan pivotally mounted on said closure means and extending up to said bin for guiding trash into said bin and being pivotal toward said bin for holding trash in said bin, and an actuator connected with said pan for pivoting said pan toward said bin for effecting a transport position of said pan and said bin.

11. The mobile sweeper as claimed in claim 9, including connection means operatively associated with said bin and said closure means for simultaneous pivoting of said bin and moving of said closure means in the emptying of trash from said compartment.

12. The mobile sweeper as claimed in claim 1, wherein said body has a second compartment in dust-flow communication with the first-mentioned said compartment, and an air filter member on said body at said second compartment for filtering air leaving said body through said second compartment.

13. The mobile sweeper as claimed in claim 12, including an air blower mounted on said body and being in air-flow communication with said remainder of said reels and with said second compartment for blowing dirt into said second compartment.

14. The mobile sweeper as claimed in claim 12, wherein said second compartment is disposed on said closure means, and including a door on said closure means adjacent said second compartment for holding dirt in said second compartment and being moved to an open position when said closure means is moved to open the first-mentioned compartment.

15. The mobile sweeper as claimed in claim 1, wherein said remainder of said reels is mounted for up and down movement between a lowered ground engaging position and a raised transport position, and powered mechanism operatively associated with said remainder of said reels for rotating and up and down movement of said remainder of said reels, and sequential controls interconnected between said emptying means and said powered mechanism, whereby said powered mechanism is actuated prior to actuation of said emptying means.

16. The mobile sweeper as claimed in claim 15, wherein said powered mechanism is hydraulic and said sequential controls are hydraulic valve means, and said emptying means includes hydraulic mechanism interconnected with said valve means.

17. The mobile sweeper as claimed in claim 1, including hydraulic mechanism having powered units respectively connected with said emptying means and with said remainder of said reels and with said closure means, and sequentially operative hydraulic valve means connected with said hydraulic mechanism for powering of said units in sequence of their respective operations.

* * * * *